US008485274B2

(12) United States Patent
Ikuta et al.

(10) Patent No.: US 8,485,274 B2
(45) Date of Patent: Jul. 16, 2013

(54) IMPACT TOOL

(75) Inventors: Hiroki Ikuta, Anjo (JP); Hikaru Kamegai, Anjo (JP)

(73) Assignee: Makita Corporation, Anjo-shi (JP)

( * ) Notice: Subject to any disclaimer, the term of this patent is extended or adjusted under 35 U.S.C. 154(b) by 855 days.

(21) Appl. No.: 12/149,876

(22) Filed: May 9, 2008

(65) Prior Publication Data

US 2008/0283264 A1 Nov. 20, 2008

(30) Foreign Application Priority Data

May 14, 2007 (JP) ..... 2007-128665
May 14, 2007 (JP) ..... 2007-128674

(51) Int. Cl.
*B25D 17/24* (2006.01)

(52) U.S. Cl.
USPC ..... 173/162.1; 173/48; 173/91

(58) Field of Classification Search
USPC ..... 173/48, 91, 137, 201, 206, 210, 162.2, 173/162.1
See application file for complete search history.

(56) References Cited

U.S. PATENT DOCUMENTS 5,775,440 A * 7/1998 Shinma ..... 173/109
5,842,527 A * 12/1998 Arakawa et al. ..... 173/48
5,873,418 A * 2/1999 Arakawa et al. ..... 173/212
5,954,140 A * 9/1999 Bauer ..... 173/48
5,975,217 A * 11/1999 Frenzel et al. ..... 173/201
6,431,290 B1 8/2002 Muhr et al.
6,644,418 B2 11/2003 Haga
6,675,908 B1 * 1/2004 Frauhammer et al. ..... 173/48
6,938,705 B2 * 9/2005 Kikuchi ..... 173/201
7,040,413 B2 * 5/2006 Mueller et al. ..... 173/13
7,143,842 B2 * 12/2006 Ikuta ..... 173/201
7,252,157 B2 * 8/2007 Aoki ..... 173/162.2
7,320,368 B2 * 1/2008 Watanabe ..... 173/48
7,712,548 B2 * 5/2010 Moessnang ..... 173/162.1
2002/0050191 A1 5/2002 Muhr et al.
2002/0185288 A1 12/2002 Hanke et al.
2003/0094292 A1 5/2003 Haga
2004/0016558 A1 * 1/2004 Mueller et al. ..... 173/201

(Continued)

FOREIGN PATENT DOCUMENTS

CN 1186173 C 1/2005
DE 815 179 10/1951

(Continued)

OTHER PUBLICATIONS

Sep. 6, 2012 Office Action issued in Russian Patent Application No. 2008118951/02(021946) (with translation).

(Continued)

*Primary Examiner* — Brian D Nash
(74) *Attorney, Agent, or Firm* — Oliff & Berridge, PLC

(57) ABSTRACT

It is an object of the invention to provide a technique that contributes to rationalization of a mechanism relating to reduction of vibration in an impact tool. Representative impact tool includes a tool body, a hammer actuating member, a dynamic vibration reducer and a positioning elastic element. The positioning elastic element contacts the hammer actuating member and thereby positions the tool body with respect to the workpiece so as to absorb a reaction force caused by rebound from the workpiece and acts on the hammer actuating member when the hammer actuating member performs the hammering operation on the workpiece. The positioning elastic element includes the elastic element formed as a component part of the dynamic vibration reducer.

8 Claims, 10 Drawing Sheets

U.S. PATENT DOCUMENTS

| | | | | |
|---|---|---|---|---|
| 2005/0145403 | A1* | 7/2005 | Kikuchi | 173/201 |
| 2006/0048958 | A1* | 3/2006 | Ikuta | 173/201 |
| 2006/0076154 | A1* | 4/2006 | Aoki | 173/212 |
| 2006/0254785 | A1* | 11/2006 | Watanabe | 173/48 |
| 2007/0039749 | A1 | 2/2007 | Aoki | |
| 2008/0185165 | A1 | 8/2008 | Moessnang | |

FOREIGN PATENT DOCUMENTS

| | | | |
|---|---|---|---|
| EP | 1 252 976 | A1 | 10/2002 |
| EP | 1 754 575 | A2 | 2/2007 |
| JP | A-52-109673 | | 9/1977 |
| JP | A-09-136273 | | 5/1997 |
| JP | A-2003-11073 | | 1/2003 |
| JP | A-2008-188760 | | 8/2008 |
| RU | 2 268 818 | C2 | 9/2005 |

OTHER PUBLICATIONS

Aug. 2, 2011 Office Action issued in Japanese Patent Application No. 2007-128665 (with translation).

Aug. 3, 2011 Office Action issued in Japanese Patent Application No. 2007-128674 (with translation).

* cited by examiner

IMPACT TOOL

BACKGROUND OF THE INVENTION

1. Field of the Invention

The present invention relates to an impact tool for performing a linear hammering operation on a workpiece, and more particularly to a technique for cushioning a reaction force received from the workpiece during hammering operation.

2. Description of the Related Art

Japanese non-examined laid-open Patent Publication No. 52-109673 discloses an electric hammer having a vibration reducing device.

SUMMARY OF THE INVENTION

It is an object of the invention to provide a technique that contributes to rationalization of a mechanism relating to reduction of vibration in an impact tool.

Above-mentioned object can be achieved by a claimed invention. A representative impact tool includes a tool body, a hammer actuating member, a dynamic vibration reducer and a positioning elastic element. The hammer actuating member performs a predetermined hammering operation on a workpiece by a striking movement in an axial direction. The dynamic vibration reducer includes a weight that can linearly move under a biasing force of an elastic element to reduce vibration during hammering operation by the movement of the weight in the axial direction of the hammer actuating member.

The positioning elastic element contacts the hammer actuating member and thereby positions the tool body with respect to the workpiece when the hammer actuating member is pressed against the workpiece and pushed to the tool body in advance of the hammering operation. In this state, the positioning elastic element absorbs a reaction force that is caused by rebound from the workpiece and acts on the hammer actuating member when the hammer actuating member performs the hammering operation on the workpiece. The positioning elastic element is defined by the elastic element of the dynamic vibration reducer.

According to the preferred embodiment of the present invention, the positioning elastic element comprises the elastic element formed as a component part of the dynamic vibration reducer. Specifically, in this invention, positioning of the tool body with respect to the workpiece is made by the elastic element of the dynamic vibration reducer. With this construction, the dynamic vibration reducer serves as a vibration reducing mechanism in which the weight and the elastic element cooperate to reduce vibration caused in the tool body in the axial direction of the hammer. Further, the elastic element of the dynamic vibration reducer elastically deforms by the reaction force that the hammer actuating member receives from the workpiece, and thereby absorbs this reaction force. As a result, transmission of the reaction force to the tool body is reduced. Thus, according to this invention, the elastic element of the dynamic vibration reducer is provided and designed to have functions of positioning the tool body and absorbing the reaction force, so that the number of parts relating to vibration reduction can be reduced and the structure can be simplified.

According to a further embodiment of the present invention, the impact tool further includes a driving mechanism that linearly drives the hammer actuating member, and a cylinder that houses the driving mechanism. The weight and the elastic element that form the dynamic vibration reducer are annularly arranged outside the cylinder. With such arrangement, the outer peripheral space of the cylinder can be effectively utilized. Further, the center of gravity of the weight in the dynamic vibration reducer can be placed on the axis of the hammer actuating member, so that generation of a couple can be prevented.

According to a further embodiment of the present invention, the reaction force that acts on the hammer actuating member comprises a vibration means for actively vibrating the weight via the elastic element. The dynamic vibration reducer inherently serves to passively suppress vibration of the tool body by vibration of the weight which is caused by vibration of the tool body. In this invention, in such a passive vibration reducing mechanism in the form of the dynamic vibration reducer, the weight is actively vibrated via the elastic element. With this construction, the vibration reducing function of the dynamic vibration reducer can be further enhanced. Particularly, in this invention, the reaction force received from the workpiece is utilized as a means for vibrating the weight. Therefore, it is not necessary to provide an additional input means for forced vibration, so that consumption of power can be effectively reduced and the structure can be simplified.

According to this invention, a technique is provided which contributes to rationalization of a mechanism relating to reduction of vibration which is caused in the tool body during hammering operation and to reduction of a reaction force received from the workpiece after striking movement, in an impact tool.

As another aspect of the invention, the representative impact tool may have a cylinder, a driving element, a striker and an air chamber. The cylinder may be housed within the tool body. The driving element may linearly move in the axial direction of the hammer actuating member. The striker may linearly move in the axial direction of the hammer actuating member within the cylinder. The air chamber may be defined between the driving element and the striker within the cylinder. The striker may be caused to linearly move via pressure fluctuations of the air chamber as a result of the linear movement of the driving element and strikes the hammer actuating member. As a result, the predetermined hammering operation is performed on the workpiece.

A positioning member may be provided to be held in contact with the hammer actuating member under loaded conditions in which the hammer actuating member is pressed against the workpiece and pushed to the side of the driving element. On the other hand, the positioning member may be separated from the hammer actuating member under unloaded conditions in which the hammer actuating member is not pressed against the workpiece. Further, an elastically deformable positioning elastic element may be provided so as to position the tool body with respect to the workpiece by contact with the positioning member under loaded conditions. The positioning elastic element may, in such position, absorbs a reaction force that is caused by rebound from the workpiece and inputted from the hammer actuating member via the positioning member.

Further, a communication part may be provided for a communication between the air chamber and the outside in order to prevent idle driving. Further, a communication part opening-closing member may be provided to include the striker disposed inside the cylinder, or a movable member disposed outside the cylinder. The communication part opening-closing member may be movable between a closed position for closing the communication part and an open position for opening the communication part. Under unloaded conditions, the communication part opening-closing member may be placed in the open position for opening the communication part and as a result, the communication part opening-closing member may disable the pressure fluctuations of the air chamber. On the other hand, under loaded conditions, the communication part opening-closing member may be pushed by the hammer actuating member or the positioning member to the closed position for closing the communication part and as a result, the communication part opening-closing member may enable the pressure fluctuations of the air chamber.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment of the Invention

Figure 1:
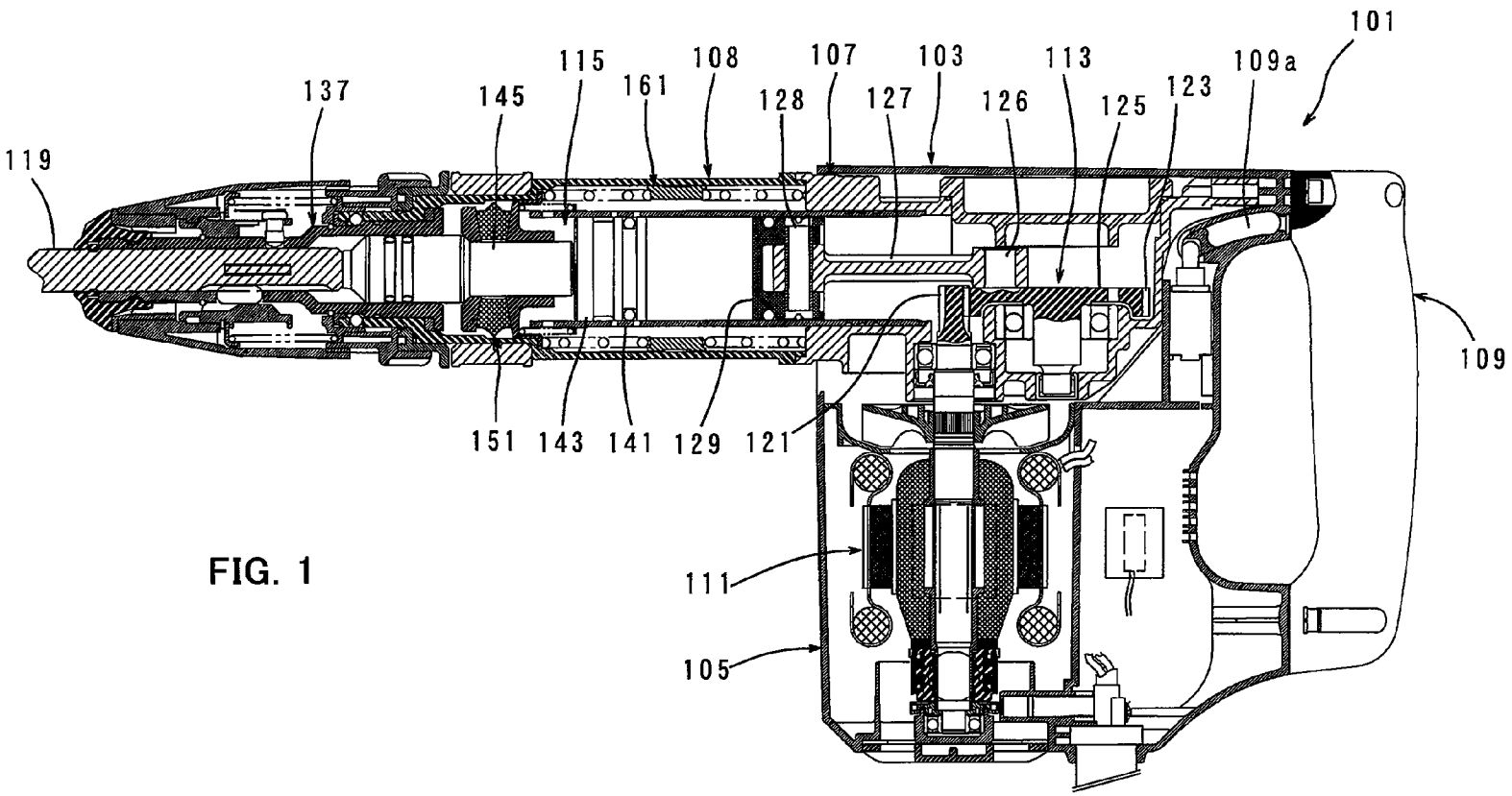
FIG. 1 is a sectional side view schematically showing an entire electric hammer according to a first embodiment of this invention.
Figure 2:
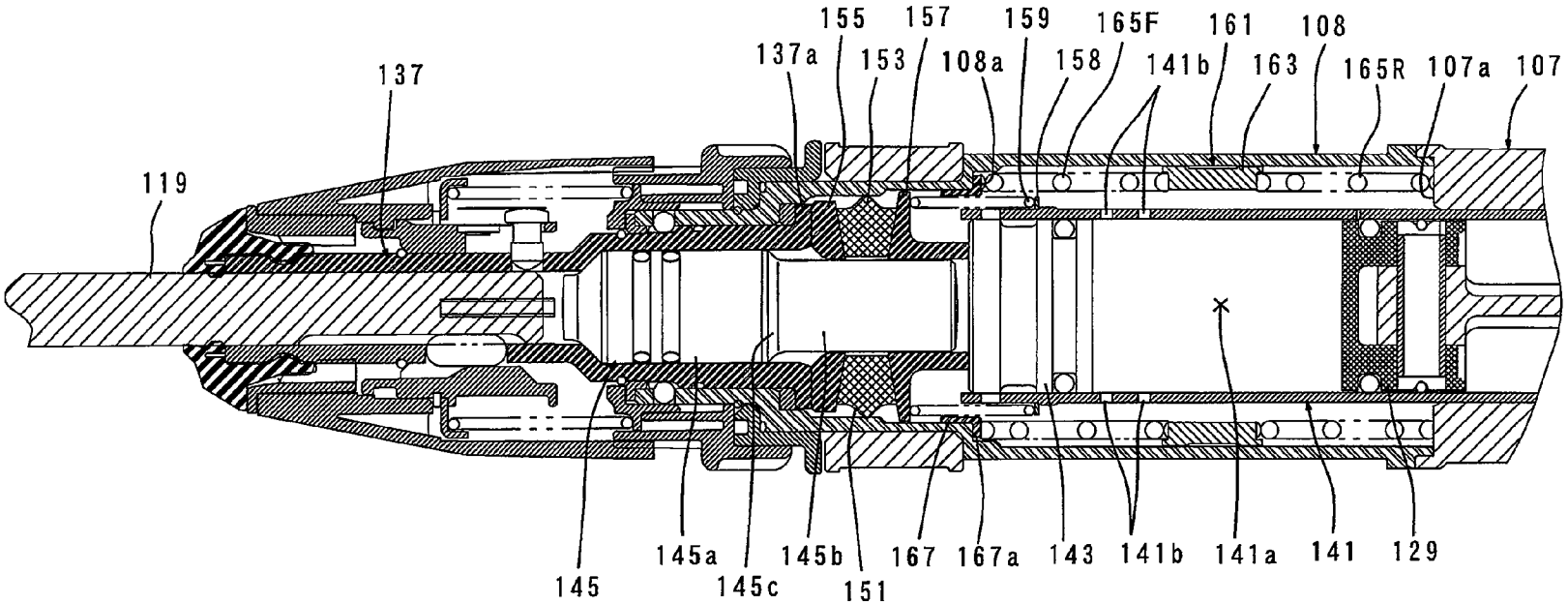
FIG. 2 is an enlarged sectional view showing an essential part of the hammer, under unloaded conditions in which a hammer bit is not pressed against a workpiece.
Figure 3:
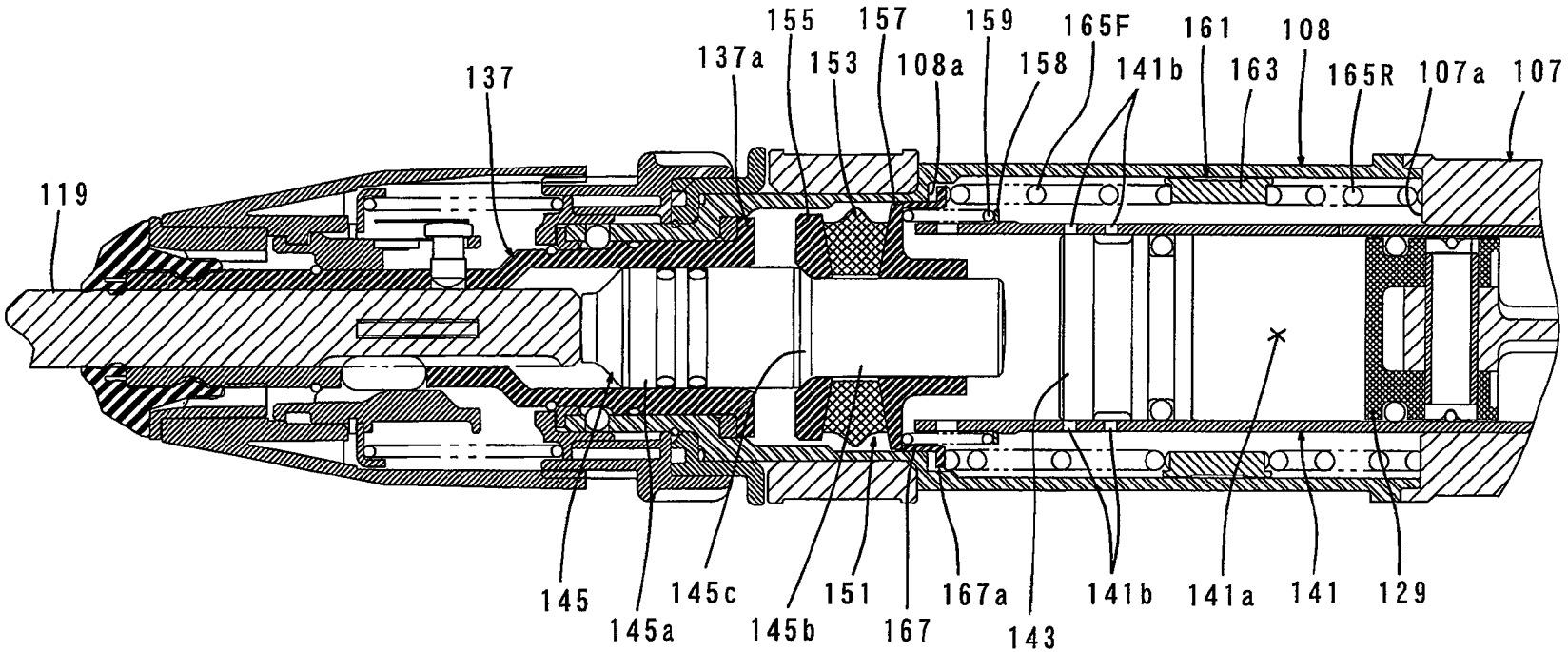
FIG. 3 is a sectional plan view showing the essential part of the hammer, under loaded conditions in which the hammer bit is pressed against a workpiece.

A first embodiment of the present invention is now described with reference to FIGS. 1 to 3. FIG. 1 is a sectional side view showing an entire electric hammer 101 as a representative embodiment of the impact tool according to the present invention. FIGS. 2 and 3 are enlarged sectional views each showing an essential part of the hammer, under unloaded conditions in which a hammer bit is not pressed against the workpiece and under loaded conditions in which the hammer bit is pressed against the workpiece, respectively.

As shown in FIG. 1, the hammer 101 of this embodiment includes a body 103, a hammer bit 119 detachably coupled to the tip end region (on the left side as viewed in FIG. 1) of the body 103 via a tool holder 137, and a handgrip 109 that is connected to the body 103 on the side opposite the hammer bit 119 and designed to be held by a user. The body 103 is a feature that corresponds to the "tool body" according to the present invention. The hammer bit 119 is held by the tool holder 137 such that it is allowed to reciprocate with respect to the tool holder 137 in its axial direction and prevented from rotating with respect to the tool holder 137 in its circumferential direction. In the present embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a motion converting mechanism 113 and a striking mechanism 115. The motion converting mechanism 113 is adapted to appropriately convert the rotating output of the driving motor 111 to linear motion and then to transmit it to the striking mechanism 115. As a result, an impact force is generated in the axial direction of the hammer bit 119 via the striking mechanism 115. Further, a slide switch 109*a* is provided on the handgrip 109 and can be slid by the user to drive the driving motor 111.

The motion converting mechanism 113 includes a driving gear 121 that is rotated in a horizontal plane by the driving motor 111, a crank plate 125 having a driven gear 123 that engages with the driving gear 121, a crank arm 127 that is loosely connected at its one end to the crank plate 125 via an eccentric shaft 126 in a position displaced a predetermined distance from the center of rotation of the crank plate 125, and a driving element in the form of a piston 129 mounted to the other end of the crank arm 127 via a connecting shaft 128. The crank plate 125, the crank arm 127 and the piston 129 form a crank mechanism.

As shown in FIGS. 2 and 3, the striking mechanism 115 includes a striker 143 that is slidably disposed within the bore of the cylinder 141, and an intermediate element in the form of an impact bolt 145 that is slidably disposed within the tool holder 137 and transmits the kinetic energy of the striker 143 to the hammer bit 119. An air chamber 141*a* is defined between the piston 129 and the striker 143 within the cylinder 141. The striker 143 is driven via the action of an air spring of the air chamber 141*a* of the cylinder 141 which is caused by sliding movement of the piston 129. The striker 143 then collides with (strikes) the intermediate element in the form of the impact bolt 145 that is slidably disposed within the tool holder 137 and transmits the striking force to the hammer bit 119 via the impact bolt 145. The impact bolt 145 and the hammer bit 119 are features that correspond to the "hammer actuating member" according to this invention.

The air chamber 141*a* serves to drive the striker 143 via the action of the air spring and communicates with the outside via air vents 141*b* that are formed in the cylinder 141 in order to prevent idle driving. Under unloaded conditions in which the hammer bit 119 is not pressed against the workpiece, or in the state in which the impact bolt 145 is not pushed rearward, the striker 143 is allowed to move to a forward position for opening the air vents 141*b* (see FIG. 2). On the other hand, under loaded conditions in which the hammer bit 119 is pressed against the workpiece by the user's pressing force applied forward to the tool body 103, the striker 143 is pushed by the retracting impact bolt 145 and moved to a rearward position for closing the air vents 141*b* (see FIG. 3). The air vents 141*b* are features that correspond to the "communication part" according to this invention.

Thus, the striker 143 controls opening and closing of the air vents 141*b* of the air chamber 141*a*. Opening of the air vents 141*b* disables the action of the air spring, while closing of the air vents 141*b* enables the action of the air spring. Specifically, the air vents 141*b* and the striker 143 form an idle driving prevention mechanism of the type that opens the air chamber to prevent the hammer bit 119 from driving under unloaded conditions (idle driving). The striker 143 is a feature that corresponds to the "communication part opening-closing member" according to this invention.

Further, the hammer 101 in this embodiment has a dynamic vibration reducer 161 for reducing vibration which is caused in the body 103 during hammering operation. An annular space is defined between the inner side of the gear housing 107 that houses the cylinder 141 and the outer side of the cylinder 141. The dynamic vibration reducer 161 mainly includes a cylindrical weight 163 disposed within the annular space, and front and rear biasing springs 165F, 165R disposed on the front and rear sides of the weight 163 in the axial direction of the hammer bit. The biasing springs 165F, 165R are features that correspond to the "elastic element" according to this invention. The front and rear biasing springs 165F, 165R exert a spring force on the weight 163 in a direction toward each other when the weight 163 moves in the axial direction of the hammer bit 119. Part of the gear housing 107 which houses the cylinder 141 is formed by a separate cylindrical member (barrel) 108. The cylindrical member 108 and the gear housing 107 are fixedly connected to each other and virtually formed as one component.

The weight 163 is arranged such that its center coincides with the axis of the hammer bit 119 and can freely slide with its outside wall surface held in contact with the inside wall surface of the cylindrical member 108. Further, the front and rear biasing springs 165F, 165R are formed by compression coil springs and, like the weight 163, they are arranged such that each of their centers coincides with the axis of the hammer bit 119. One end (rear end) of the rear biasing spring 165R is held in contact with a spring receiving surface 107*a* of the gear housing 107, while the other end (front end) is held in contact with the axial rear end of the weight 163. Further, one end (rear end) of the front biasing spring 165F is held in contact with the axial front end of the weight 163, while the other end (front end) is held in contact with a spring receiving member 167.

The spring receiving member 167 is configured as a ring having a radially outwardly protruding flange 167*a*. The spring receiving member 167 is fitted in the bore of the cylindrical member 108 such that it can slide in the axial direction of the hammer bit. The flange 167*a* of the spring receiving member 167 contacts a stepped engagement surface 108*a* of the cylindrical member 108 from the rear and is normally held in this contact position.

The dynamic vibration reducer 161 having the above-described construction serves to reduce impulsive and cyclic vibration caused during hammering operation (when the hammer bit 119 is driven). Specifically, the weight 163 and the biasing springs 165F, 165R serve as vibration reducing elements in the dynamic vibration reducer 161 and cooperate to passively reduce vibration of the body 103 of the hammer 101. Thus, the vibration of the hammer 101 can be effectively alleviated or reduced.

In the hammer 101, when the hammer bit 119 is pressed against the workpiece by the user's pressing force applied forward to the body 103, the impact bolt 145 is pushed rearward (toward the piston 129) together with the hammer bit 119 and comes into contact with a body-side member. As a result, the body 103 is positioned with respect to the workpiece. In this embodiment, such positioning is effected by the above-described biasing springs 165F, 165R of the dynamic vibration reducer 161 via a positioning member 151.

The positioning member 151 is a unit part including a rubber ring 153, a front-side hard metal washer 155 joined to the axial front side of the rubber ring 153, and a rear-side hard metal washer 157 joined to the axial rear side of the rubber ring 153. The positioning member 151 is loosely fitted onto a small-diameter portion 145*b* of the impact bolt 145. The impact bolt 145 has a stepped, cylindrical form having a large-diameter portion 145*a* that is slidably fitted in the cylindrical portion of the tool holder 137 and a small-diameter portion 145*b* formed on the rear side of the large-diameter portion 145*a*. The impact bolt 145 has a tapered portion 145*c* formed between the outside wall surface of the large-diameter portion 145*a* and the outside wall surface of the small-diameter portion 145*b*. Further, the positioning member 151 is disposed between the outside wall surface of the small-diameter portion 145*b* and the inside wall surface of the cylindrical member 108.

Under loaded conditions in which the hammer bit 119 is pressed against the workpiece by the user, when the impact bolt 145 is retracted together with the hammer bit 119, the tapered portion 145*c* of the impact bolt 145 contacts the positioning member 151 in a predetermined retracted position and pushes the positioning member 151 rearward. Then the positioning member 151 comes into contact with the front end surface of the spring receiving member 167. Specifically, the biasing springs 165F, 165R elastically receive the user's pressing force of pressing the hammer bit 119 against the workpiece, so that the body 103 is positioned with respect to the workpiece. Therefore, the biasing springs 165F, 165R are configured to normally have excess pressure larger than a user's force of pressing the hammer bit 119 against the workpiece.

The positioning member 151 is biased forward by a coil spring 159. Thus, under unloaded conditions in which the hammer bit 119 is not pressed against the workpiece, the positioning member 151 is moved to a forward position in which the axial front end of the front metal washer 155 contacts a rear end 137*a* of the tool holder 137 and held in the position. By thus moving the positioning member 151 to the forward position, the impact bolt 145 can be placed away from the striker 143. As a result, the striker 143 is prevented from idle driving the hammer bit 119 when the piston 129 is driven under unloaded conditions. Further, the positioning member 151 held in the forward position is separated from the tapered portion 145*c* of the impact bolt 145. The coil spring 159 is disposed outside the cylinder 141 and arranged radially inward of the front biasing spring 165F of the dynamic vibration reducer 161 in parallel to the biasing spring 165F. One axial end (rear end) of the coil spring 159 is received by a retaining ring 158 fastened to the cylinder 141, and the other end is held in contact with the rear end surface of the rear metal washer 157.

Operation of the hammer 101 constructed as described above is now explained. When the driving motor 111 (shown in FIG. 1) is driven, the rotating output of the driving motor 111 causes the driving gear 121 to rotate in the horizontal plane. When the driving gear 121 rotates, the crank plate 125 revolves in the horizontal plane via the driven gear 123 that engages with the driving gear 121. Then, the piston 129 is caused to linearly slide within the cylinder 141 via the crank arm 127. At this time, under unloaded conditions in which the hammer bit 119 is not pressed against the workpiece, as shown in FIG. 2, the positioning member 151 is biased forward by the coil spring 159 and placed in the forward position defined by the rear end 137*a* of the tool holder 137. As a result, the striker 143 moves or is allowed to move to its forward position for opening the air vents 141*b*. Therefore, when the piston 129 moves forward or rearward, air is let out of or into the air chamber 141*a* through the air vents 141*b*. Thus, the air chamber 141*a* is prevented from performing the action of the compression spring. This means that the hammer bit 119 is prevented from idle driving.

On the other hand, under loaded conditions in which the hammer bit 119 is pressed against the workpiece, as shown in FIG. 3, the impact bolt 145 is pushed rearward together with the hammer bit 119 and in turn pushes the striker 143 rearward, so that the striker 143 closes the air vents 141*b*. Thus, the striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on the workpiece.

As described above, hammering operation is performed under the loaded conditions in which the hammer bit 119 is pressed against the workpiece. When the hammer bit 119 is pressed against the workpiece, the hammer bit 119 is pushed rearward and in turn retracts the impact bolt 145. The retracting impact bolt 145 pushes the positioning member 151 rearward. The rear metal washer 157 of the positioning member 151 then contacts the spring receiving member 167 of the dynamic vibration reducer 161. Thus, the biasing springs 165F, 165R of the dynamic vibration reducer 161 elastically receive the user's pressing force of pressing the hammer bit 119 against the workpiece, so that the body 103 is positioned with respect to the workpiece. In this state, a hammering operation is performed. During hammering operation, the dynamic vibration reducer 161 serves as a vibration reducing mechanism in which the weight 163 and the biasing springs 165F, 165R cooperate to passively reduce cyclic vibration caused in the body 103 in the axial direction of the hammer bit. Thus, the vibration of the hammer 101 can be effectively alleviated or reduced.

After striking movement of the hammer bit 119 upon the workpiece, the hammer bit 119 is caused to rebound by the reaction force from the workpiece. A force caused by this rebound or reaction force moves the impact bolt 145, the positioning member 151 and the spring receiving member 167 rearward and elastically deforms the biasing springs 165F, 165R. Specifically, the reaction force caused by rebound of the hammer bit 119 is absorbed by elastic deformation of the biasing springs 165F, 165R, so that transmission of the reaction force to the body 103 is reduced. At this time, the rear metal washer 157 of the positioning member 151 faces the front end surface of the cylinder 141 with a predetermined clearance therebetween and can come into contact with it, so that the maximum retracted position of the positioning member 151 is defined. Therefore, the reaction force absorbing action of the biasing springs 165F, 165R is effected within the range of the above-mentioned clearance.

As described above, in this embodiment, the biasing springs 165F, 165R of the dynamic vibration reducer 161 are utilized to position the body 103 with respect to the workpiece in advance of a hammering operation and to absorb the reaction force that the hammer bit 119 receives from the workpiece after its striking movement. This means that a spring for absorption of the reaction force and a spring for the dynamic vibration reducer 161 are formed as one common part, so that the number of parts relating to vibration reduction can be reduced and the structure an be simplified.

Further, the reaction force of rebound of the hammer bit 119 is inputted to the weight 163 via the impact bolt 145, the positioning member 151, the spring receiving member 167 and the biasing springs 165F, 165R. Specifically, the reaction force of rebound of the hammer bit 119 serves as a vibration means for actively vibrating (driving) the weight 163 of the dynamic vibration reducer 161. Thus, the dynamic vibration reducer 161 serves as an active vibration reducing mechanism for reducing vibration by forced vibration in which the weight 163 is actively driven. Therefore, the vibration which is caused in the body 103 during hammering operation can be further effectively reduced or alleviated. As a result, a sufficient vibration reducing function can be ensured even in the operating conditions in which, although vibration reduction is highly required, only a small amount of vibration is inputted to the dynamic vibration reducer 161 and the dynamic vibration reducer 161 does not sufficiently function, particularly, for example, in an operation which is performed with the user's strong pressing force applied to the power tool.

Further, in this embodiment, positioning of the body 103 is performed by the biasing springs 165F, 165R. With this construction, by strongly pressing the hammer bit 119 against the workpiece, the biasing springs 165F, 165R can be deformed so that the impact bolt 145 is allowed to move farther rearward. Specifically, according to this invention, when the hammer bit 119 is strongly pressed against the workpiece, the amount of movement of the striker 143 toward the piston 129 can be increased, so that suction of the striker 143 is improved. The suction here represents a phenomenon in which, when the air chamber 141*a* expands by the retracting movement of the piston 129, air within the air chamber 141*a* is cooled and the pressure of the air chamber 141*a* is reduced, which causes the striker 143 to move rearward.

Further, in this embodiment, the front biasing spring 165F of the dynamic vibration reducer 161 and the coil spring 159 that biases the positioning member 151 forward are arranged in parallel in the radial direction and in the same position on the axis of the hammer bit 119. Thus, an effective configuration for space savings can be realized. Further, in this embodiment, under loaded conditions in which the hammer bit 119 is pressed against the workpiece, the rear metal washer 157 of the positioning member 151 faces the front end surface of the cylinder 141 with a predetermined clearance therebetween and can come into contact with it, so that the maximum retracted position of the positioning member 151 is defined. Thus, the hammer bit 119 and the impact bolt 145 and the striker 143 which are pushed by the hammer bit 119 can be prevented from moving rearward beyond the above-mentioned maximum retracted position.

Further, in this embodiment, the weight 163 and the biasing springs 165F, 165R which form the dynamic vibration reducer 161 are annularly arranged outside the cylinder 141. Thus, the outer peripheral space of the cylinder 141 can be effectively utilized. Further, it can be arranged such that the centers of gravity of the weight 163 and the biasing springs 165F, 165R are placed on the axis of the hammer bit 119. As a result, a couple (force of lateral rotation around an axis extending transverse to the longitudinal direction of the hammer bit) can be prevented from acting upon the body 103.

Figure 4:
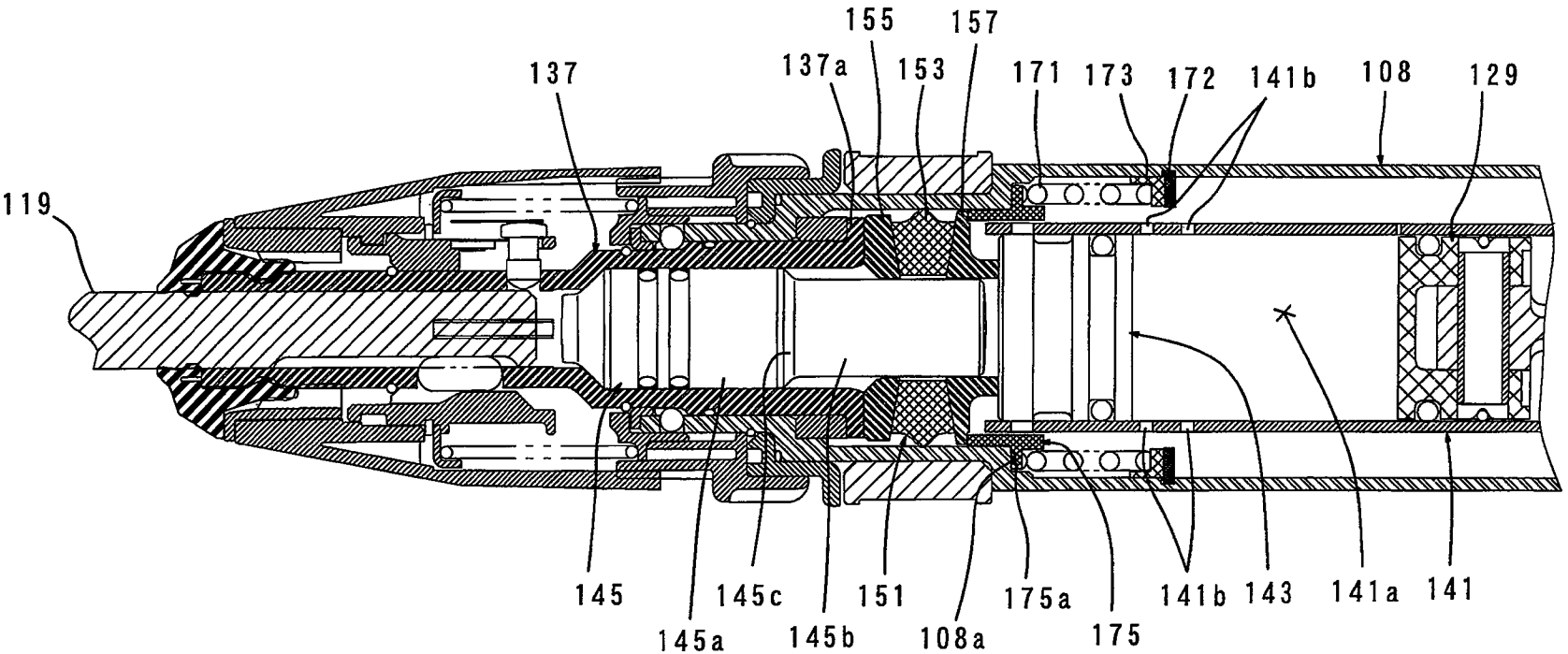
FIG. 4 is an enlarged sectional view showing an essential part of an electric hammer according to a modification to the first embodiment, under unloaded conditions in which a hammer bit is not pressed against a workpiece.
Figure 5:
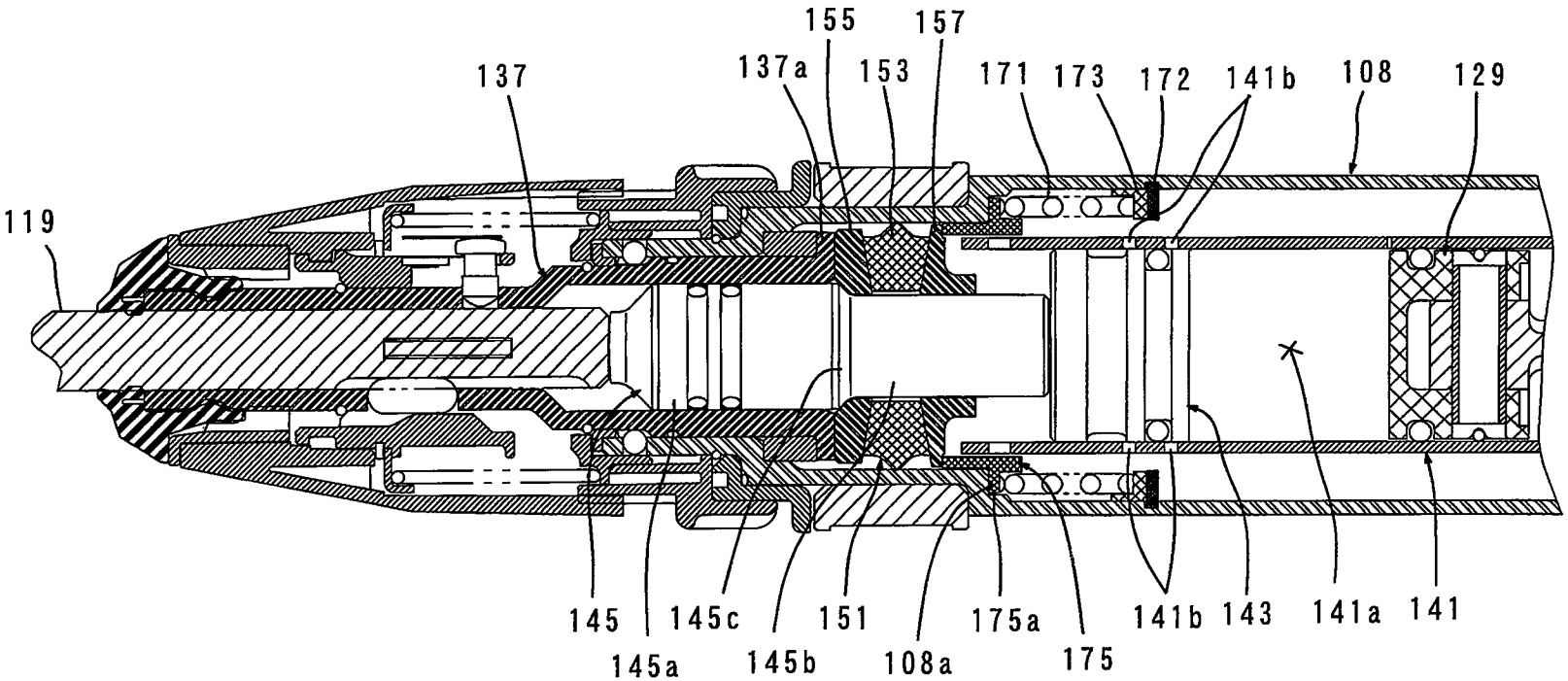
FIG. 5 is a sectional plan view also showing the essential part of the electric hammer according to the modification, under loaded conditions in which the hammer bit is pressed against a workpiece.
Figure 6:
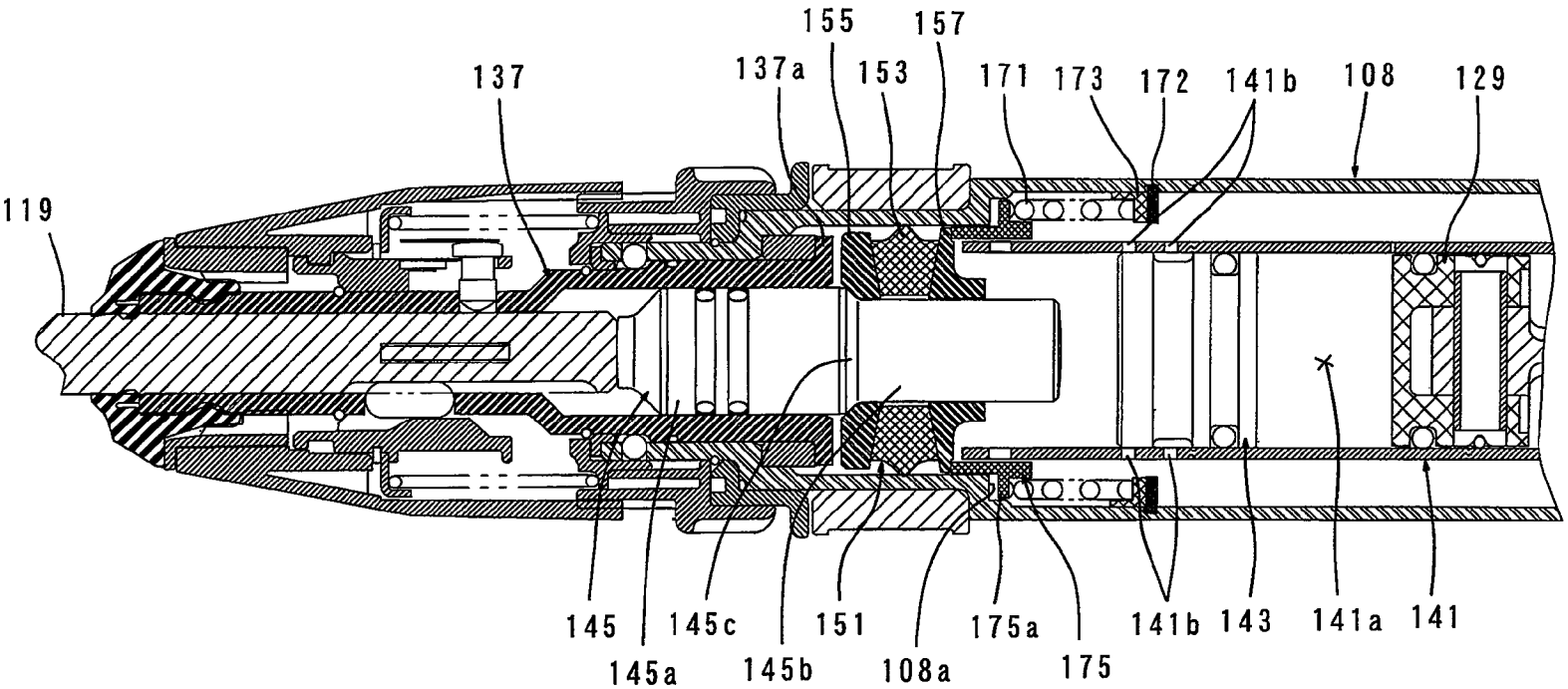
FIG. 6 is a sectional plan view also showing the essential part of the electric hammer, in the reaction force absorbing state.

A modification to the first embodiment is now explained with reference to FIGS. 4 to 6. In the above-described first embodiment, the biasing springs 165F, 165R of the dynamic vibration reducer 161 are utilized to absorb the reaction force that the hammer bit 119 receives from the workpiece. In contrast, in this modification, a compression coil spring 171 specifically designed to absorb the reaction force is provided. In the other points, it has the same construction as the first embodiment. Components or elements in this modification which are substantially identical to those in the first embodiment are given like numerals as in the first embodiment and will not be described. The compression coil spring 171 is a feature that corresponds to the "positioning elastic element" in this invention.

The compression coil spring 171 is disposed outside the cylinder 141. One axial end (rear end) of the compression coil spring 171 is held in contact with the front surface of a spring receiving ring 173 which is fastened to the cylindrical member 108 via a retaining ring 172, while the other end (front end) is held in contact with the rear surface of a reaction force transmitting member in the form of a spring receiving member 175. The spring receiving member 175 is a ring-like component having a radially outwardly protruding flange 175*a*. The spring receiving member 175 is fitted in the bore of the cylindrical member 108 such that it can slide in the axial direction of the hammer bit. The spring receiving member 175 is pushed forward (leftward as viewed in the drawings) by the compression coil spring 171, and the flange 175*a* contacts the stepped engagement surface 108*a* of the cylindrical member 108 from the rear and is normally held in this contact position. In this state of contact, the front end of the spring receiving member 175 is held in contact with the rear surface of the rear metal washer 157. Therefore, under unloaded conditions in which the hammer bit 119 is not pressed against the workpiece, the positioning member 151 is held in contact with the rear end 137*a* of the tool holder 137, while it is separated from the tapered portion 145*c* of the impact bolt 145. This state is shown in FIG. 4.

According to the modification having the above-described construction, when the hammer bit 119 is pressed against the workpiece in order to perform the hammering operation, the impact bolt 145 is retracted together with the hammer bit 119, and then the tapered portion 145*c* of the impact bolt 145 contacts the front metal washer 155 of the positioning member 151. The rear metal washer 157 of the positioning member 151 is in contact with the spring receiving member 175 that receives the biasing force of the compression coil spring 171. Therefore, the compression coil spring 171 elastically receives the pressing force of pressing the hammer bit 119 against the workpiece. This state is shown in FIG. 5. In this manner, the body 103 is positioned with respect to the workpiece, and in this state, the hammering operation is performed.

When the hammer bit 119 is caused to rebound by the reaction force from the workpiece after striking movement of the hammer bit 119 upon the workpiece, a force caused by this rebound or reaction force moves the hammer bit 119, the positioning member 151 and the spring receiving member 175 rearward and elastically deforms the compression coil spring 171. Specifically, the reaction force caused by rebound of the hammer bit 119 is absorbed by elastic deformation of the compression coil spring 171, so that transmission of the reaction force to the body 103 is reduced. This state is shown in FIG. 6.

In this modification, the idle driving prevention is performed in the same manner as in the first embodiment.

Second Embodiment of the Invention

Figure 7:
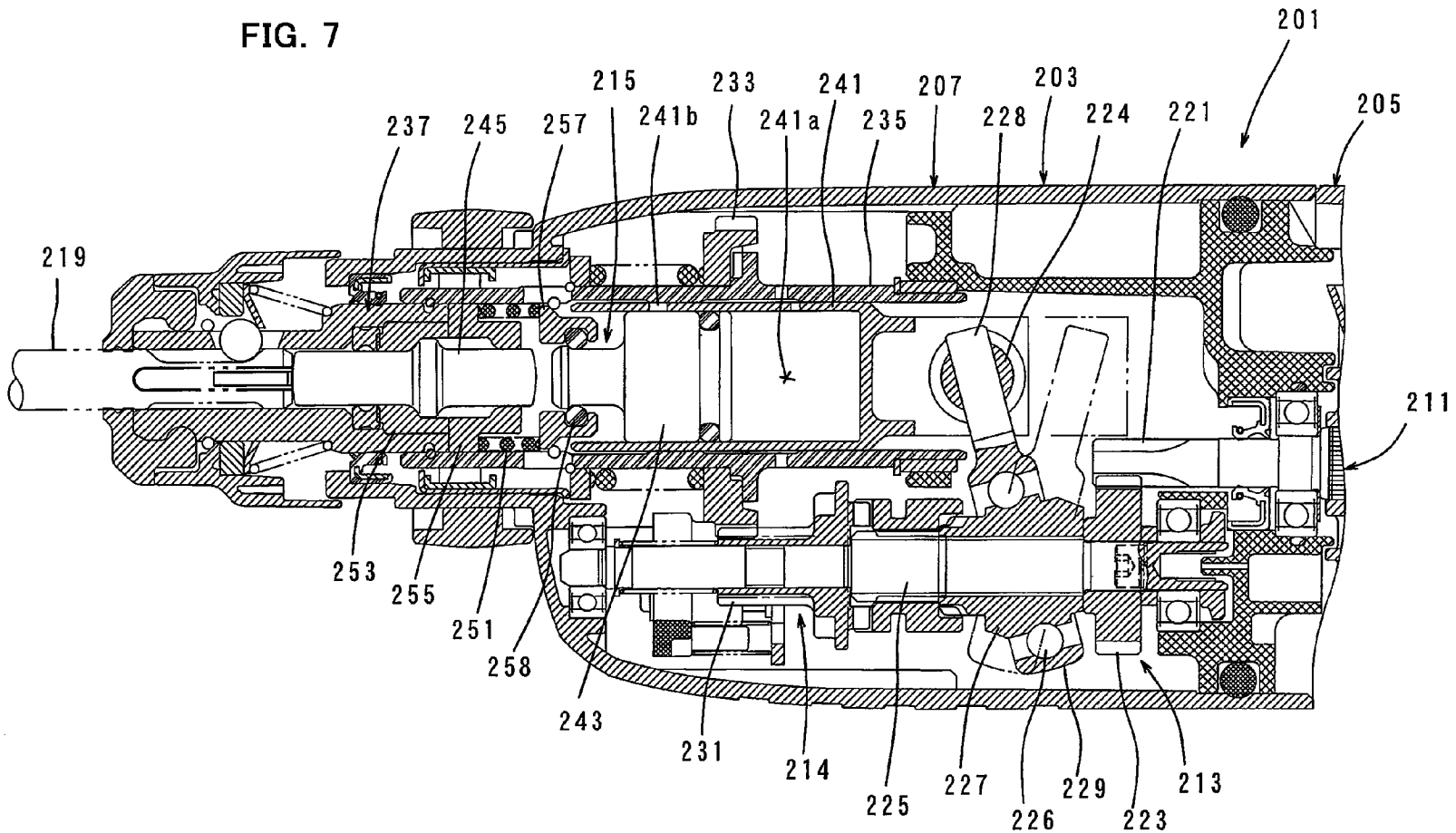
FIG. 7 is a sectional side view showing a hammer drill according to a second embodiment of this invention, in the trapped state (idle driving prevented state) of a striker.
Figure 8:
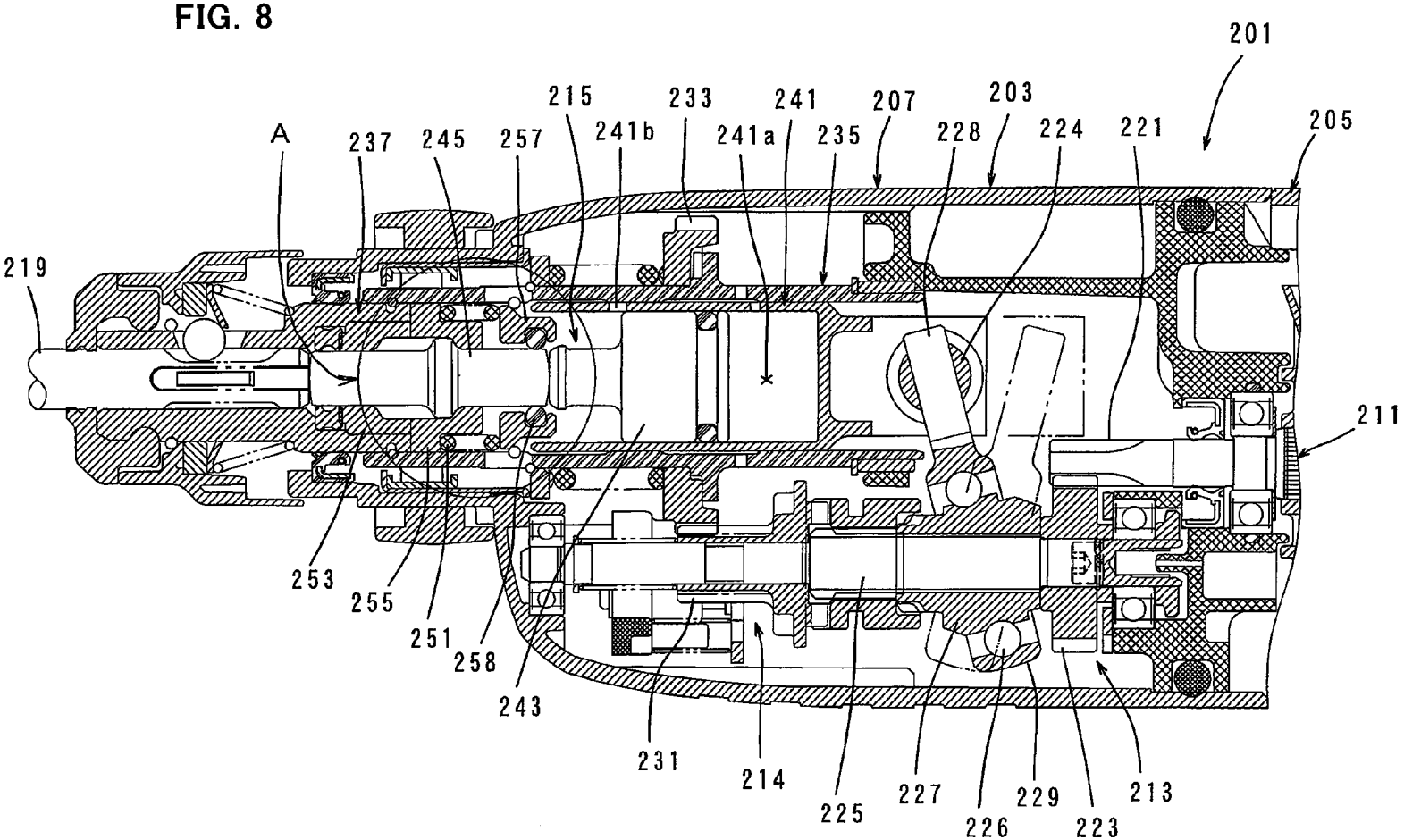
FIG. 8 is also a sectional side view showing the hammer drill according to the second embodiment, during striking movement.
Figure 9:
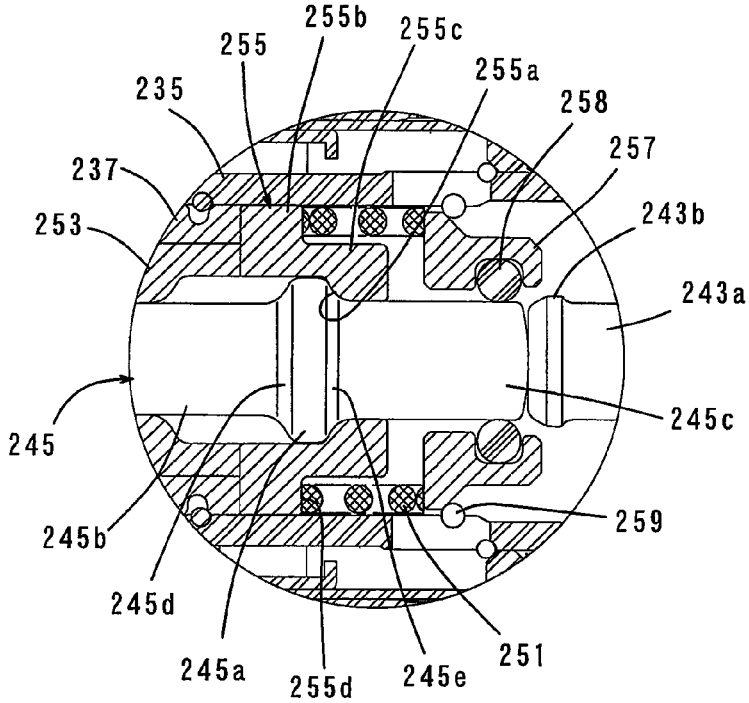
FIG. 9 is an enlarged view of part A in FIG. 8.
Figure 10:
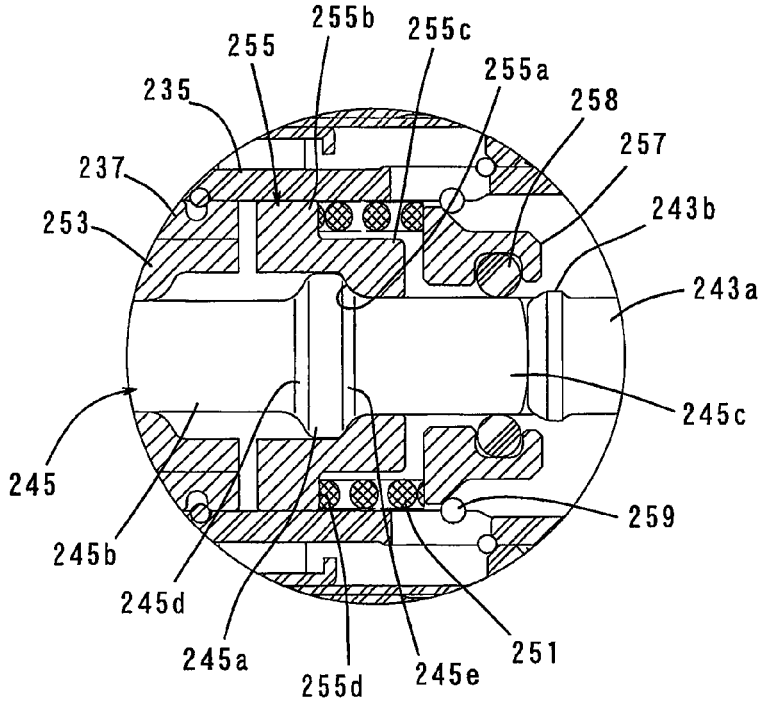
FIG. 10 is also an enlarged view of part A in FIG. 8, in the reaction force absorbing state.

A second embodiment of the present invention is now described with reference to FIGS. 7 to 10. FIGS. 7 and 8 are sectional side views schematically showing an entire hammer drill 201 as a representative embodiment of the impact tool according to the present invention, in the idle driving prevented state (under unloaded conditions) and during striking movement, respectively. FIGS. 9 and 10 are enlarged views of part A in FIG. 8, and FIG. 10 shows the reaction force absorbing state. As shown in FIGS. 7 and 8, the hammer drill 201 includes a body 203, a hammer bit 219 detachably coupled to the tip end region (on the left side as viewed in the drawings) of the body 203 via a tool holder 237, and a handgrip (not shown) that is connected to the body 203 on the side opposite the hammer bit 219 and designed to be held by a user. The body 203 is a feature that corresponds to the "tool body" according to the present invention. The hammer bit 219 is held by the tool holder 237 such that it is allowed to reciprocate with respect to the tool holder 237 in its axial direction and prevented from rotating with respect to the tool holder 237 in its circumferential direction. In the present embodiment, for the sake of convenience of explanation, the side of the hammer bit 219 is taken as the front side and the side of the handgrip as the rear side.

The body 203 includes a motor housing 205 that houses a driving motor 211 (of which end of the motor output shaft is shown), and a gear housing 207 that houses a motion converting mechanism 213, a power transmitting mechanism 214 and a striking mechanism 215. The motion converting mechanism 213 is adapted to appropriately convert the rotating output of the driving motor 211 to linear motion and then to transmit it to the striking mechanism 215. As a result, an impact force is generated in the axial direction of the hammer bit 219 via the striking mechanism 215. Further, the speed of the rotating output of the driving motor 211 is appropriately reduced by the power transmitting mechanism 214 and then transmitted to the hammer bit 219. As a result, the hammer bit 219 is caused to rotate in the circumferential direction.

The motion converting mechanism 213 includes a driving gear 221 that is rotated in a vertical plane by the driving motor 211, a driven gear 223 that engages with the driving gear 221, a rotating element 227 that rotates together with the driven gear 223 via an intermediate shaft 225, a swinging ring 229 that is caused to swing in the axial direction of the hammer bit 219 by rotation of the rotating element 227, and a cylindrical piston 241 that is caused to reciprocate by swinging movement of the swinging ring 229. The cylindrical piston 241 is formed by integrating a cylinder and a piston and slidably supported by a cylindrical cylinder guide 235. The cylindrical piston 241 is a feature that corresponds to the "cylinder" and the "driving element" according to this invention. The intermediate shaft 225 is disposed parallel (horizontally) to the axial direction of the hammer bit 219. The outside wall surface of the rotating element 227 fitted onto the driven shaft 225 is inclined at a predetermined angle with respect to the axis of the intermediate shaft 225. The swinging ring 229 is supported on the inclined outside wall surface of the rotating element 227 via a bearing 226 such that it can rotate with respect to the rotating element 227. The swinging ring 229 is caused to swing in the axial direction of the hammer bit 219 by rotation of the rotating element 227. The rotating element 227 and the swinging ring 229 that is rotatably supported on the rotating element 227 via the bearing 226 form a swinging mechanism.

A swinging rod 228 is formed in the upper end region of the swinging ring 229 and extends upward (in the radial direction) from the swinging ring 229. The swinging rod 228 is loosely fitted in an engagement part 224 that is formed in the rear end portion of the cylindrical piston 241. The cylindrical piston 241 is slidably disposed within the cylinder guide 235, and it is driven by the swinging movement (components of the movement in the axial direction of the hammer bit 219) of the swinging ring 229 and reciprocates along the cylinder guide 235.

The power transmitting mechanism 214 includes a first transmission gear 231 that is caused to rotate in a vertical plane by the driving motor 211 via the driving gear 221 and the intermediate shaft 225, a second transmission gear 233 that engages with the first transmission gear 231, and the cylinder guide 235 that is caused to rotate together with the second transmission gear 233. The rotational driving force of the cylinder guide 235 is transmitted to the tool holder 237 and further to the hammer bit 219 held by the tool holder 237. The cylinder guide 235 is mounted such that it can rotate around the axis while being prevented from moving in the axial direction with respect to the gear housing 207.

The striking mechanism 215 includes a striker 243 that is slidably disposed within the bore of the cylindrical piston 241, and an intermediate element in the form of an impact bolt 245 that is slidably disposed within the tool holder 237 and is adapted to transmit the kinetic energy of the striker 243 to the hammer bit 219. The striker 243 is driven via the action of an air spring of an air chamber 241*a* of the cylindrical piston 241 which is caused by sliding movement of the cylindrical piston 241. The striker 243 then collides with (strikes) the impact bolt 245 that is slidably disposed within the tool holder 237 and transmits the striking force to the hammer bit 219 via the impact bolt 245. The cylindrical piston 241, the striker 243 and the impact bolt 245 form the tool driving mechanism. The impact bolt 245 and the hammer bit 219 are features that correspond to the "hammer actuating member" according to this invention.

Air vents 241*b* for preventing idle driving are formed in a cylinder part of the cylindrical piston 241 and provides communication between the air chamber 241*a* and the outside. A ring case 257 having an O-ring for preventing idle driving is disposed on the front portion of the striker 243. As shown in FIGS. 9 and 10, a small-diameter striking part 243*a* for striking the impact bolt 245 is formed on the tip end side (front end side) of the striker 243, and a flange 243*b* is formed on the outer periphery of the end of striking part 243*a* and protrudes radially outward therefrom. When the striker 243 is caused to move forward past a normal striking position (shown in FIG. 8), the flange 243*b* of the striking part 243*a* moves forward past the O-ring 258. Thus, the O-ring 258 elastically traps the striker 243. This state is shown in FIG. 7. When the striker 243 is placed in the forward position in which it is trapped by the O-ring 258, the idle-driving preventing air vents 241*b* are opened and provide communication with the outside during reciprocating movement of the cylindrical piston 241. Therefore, air is let out of or into the air chamber 241*a* through the air vents 241*b*. Thus, the striker 243 is prevented from driving under unloaded conditions or idle driving.

Under loaded conditions in which the hammer bit 219 is pressed against the workpiece, as shown in FIG. 8, the impact bolt 245 is retracted together with the hammer bit 219 and in turn pushes the end of the striking part 243*a*. As a result, the flange 243*b* of the striking part 243*a* is disengaged from the O-ring 258. Thus, the striker 243 is freed from trapping of the O-ring 258 and moved to the rear striking position. When the striker 243 is placed in the striking position, the striker 243 keeps the idle-driving preventing air vents 241*b* closed during reciprocating movement of the cylindrical piston 241. As a result, the action of the air spring of the air chamber 241*a* is enabled. The air vents 241*b*, the O-ring 258 and the striker 243 as described above form an idle driving prevention mechanism The air vents 241*b* and the striker 243 are features that correspond to the "communication part" and the "communication part opening-closing member", respectively, according to this invention.

Further, the ring case 257 is fitted inside the cylinder guide 235 on the front end side, and a retaining ring 259 fastened to the cylinder guide 235 prevents the ring case 257 from moving rearward.

A mechanism for positioning the body 203 with respect to the workpiece when the hammer bit 219 is pressed against the workpiece, and a mechanism for absorbing the reaction force caused by rebound of the hammer bit 219 during hammering operation are now described. As shown in FIGS. 9 and 10, the impact bolt 245 has a stepped, cylindrical form having a large-diameter portion 245*a*, small-diameter portions 245*b*, 245*c* formed on the front and rear sides of the large-diameter portion 245*a* in the axial direction, and front and rear tapered portions 245*d*, 245*e* formed between the large-diameter portion 245*a* and the front and rear small-diameter portions 245*b*, 245*c*. Front and rear ring holders 253, 255 allow the impact bolt 245 to freely slide in the axial direction. When the hammer bit 219 is pressed against the workpiece and moved rearward, the impact bolt 245 is retracted together with the hammer bit 219. At this time, the rear tapered portion 245*e* comes into contact with an inside tapered portion 255*a* of the rear ring holder 255. The rear ring holder 255 is a feature that corresponds to the "positioning member" according to this invention.

The rear ring holder 255 is fitted in the front end portion of the cylinder guide 235 such that it can slide in the axial direction. The rear ring holder 255 is disposed forward of the above-described ring case 257 and faces it. A compression coil spring 251 for absorbing the reaction force is disposed between the ring case 257 and the rear ring holder 255. Therefore, when the hammer bit 219 is pressed against the workpiece, the force of pressing the hammer bit 219 against the workpiece is elastically received by the compression coil spring 251 via the rear ring holder 255. Thus, the body 103 is positioned with respect to the workpiece. At this time, the compression coil spring 251 is configured to normally have excess pressure larger than a user's force of pressing the hammer bit 119 against the workpiece. The compression coil spring 251 is a feature that corresponds to the "positioning elastic element" and the "coil spring", and the ring case 257 corresponds to the "facing member", according to this invention.

Further, the rear ring holder 255 has a stepped outside shape having a large-diameter portion 255*b* on the front side and a small-diameter portion 255*c* on the rear side. The axial front region of the compression coil spring 251 is placed over the small-diameter portion 255*c*. The axial front end of the compression coil spring 251 is held in contact with a stepped engagement surface 255*d* formed between the large-diameter portion 255*b* and the small-diameter portion 255*c* of the rear ring holder 255, while the rear end of the compression coil spring 251 is held in contact with a front surface of the ring case 257. Thus, the contact point between the compression coil spring 251 and the rear ring holder 255 is located forward of the contact point between the impact bolt 245 and the rear ring holder 255.

Operation of the hammer drill 201 constructed as described above is now explained. When the driving motor 211 is driven, the rotating element 227 is caused to rotate in a vertical plane via the driven gear 223 that engages with the driving gear 221 and the intermediate shaft 225. The swinging ring 229 and the swinging rod 228 then swing. The cylindrical piston 241 is then caused to linearly slide by the swinging movement of the swinging rod 228. At this time, if the striker 243 is trapped by the O-ring 258 under the unloaded conditions in which the hammer bit 219 is not pressed against the workpiece, the striker 243 is placed in the forward position for opening the air vents 241*b*. Therefore, when the cylindrical piston 241 is moved forward or rearward, air is let out of or into the air chamber 241*a* through the air vents 241*b*. Thus, the hammer bit 219 is prevented from idle driving.

Under loaded conditions in which the hammer bit 219 is pressed against the workpiece, as shown in FIG. 8, the impact bolt 245 is pushed rearward together with the hammer bit 219 and in turn pushes the striker 243 rearward, so that the striker 243 closes the air vents 241*b*. Thus, the striker 243 reciprocates within the cylinder 241 and collides with the impact bolt 245 by the action of the air spring function of the air chamber 241*a* of the cylindrical piston 241 as a result of the sliding movement of the cylindrical piston 241. The kinetic energy of the striker 243 which is caused by the collision with the impact bolt 245 is transmitted to the hammer bit 219.

When the first transmission gear 231 rotates together with the intermediate shaft 225, the cylinder guide 235 is caused to rotate in a vertical plane via the second transmission gear 233 that engages with the first transmission gear 231. Further, the tool holder 237 and the hammer bit 219 held by the tool holder 237 are caused to rotate together with the cylinder guide 235. Thus, the hammer bit 219 performs a hammering movement in the axial direction and a drilling movement in the circumferential direction, so that the hammer drill operation is performed on the workpiece.

As described above, the hammer drill operation is performed under loaded conditions in which the hammer bit 219 is pressed against the workpiece. When the hammer bit 219 is pressed against the workpiece, the hammer bit 219 is pushed rearward and retracts the impact bolt 245. The retracted impact bolt 245 comes into contact with the rear ring holder 255. Thus, the user's pressing force of pressing the hammer bit 219 against the workpiece is elastically received by the compression coil spring 251. As a result, the body 203 is positioned with respect to the workpiece, and in this state, the hammer drill operation is performed.

After striking movement of the hammer bit 219 upon the workpiece, the hammer bit 219 is caused to rebound by the reaction force from the workpiece. A force caused by this rebound or reaction force moves the impact bolt 245 and the rear ring holder 255 rearward and elastically deforms the compression coil spring 251. Specifically, the reaction force caused by rebound of the hammer bit 219 is absorbed by elastic deformation of the compression coil spring 251, so that transmission of the reaction force to the body 203 is reduced. At this time, the rear end surface of the rear ring holder 255 faces the front end surface of the ring case 257 with a predetermined clearance therebetween, so that the maximum retracted position of the rear ring holder 255 is defined. Therefore, the reaction force absorbing action of the compression coil spring 251 is effected within the range of the above-mentioned clearance.

As described above, in this embodiment, the compression coil spring 251 is used to position the body 203 with respect to the workpiece in advance of a hammer drill operation and to absorb the reaction force that the hammer bit 219 receives from the workpiece after its striking movement. With this construction, compared with the construction, for example, in which a rubber ring is used to absorb the reaction force, the spring constant can be reduced and the reaction force absorbing effect can be enhanced.

Further, in this embodiment, the rear ring holder 255 has the small-diameter portion 255*c* on the rear side and the compression coil spring 251 is placed over the small-diameter portion 255*c*. Specifically, it is configured such that the axial front region of the compression coil spring 251 is placed over the outside portion of the rear ring holder 255 and the contact point between the compression coil spring 251 and the rear ring holder 255 is located forward of the contact point between the impact bolt 245 and the rear ring holder 255. With this construction, ensuring a predetermined amount of elastic deformation of the compression coil spring 251 which is required to absorb the reaction force, the compression coil spring 251 can be reduced in the length in the axial direction of the hammer drill 201.

Figure 11:
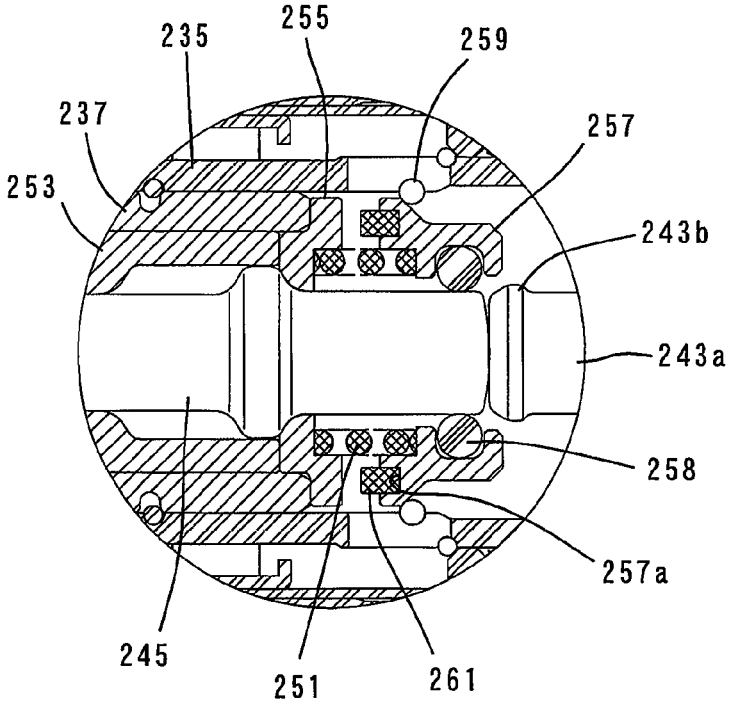
FIG. 11 is an enlarged view of an essential part of a modification to the second embodiment, during striking movement.

A modification to the second embodiment is now explained with reference to FIGS. 11 and 12. In the above-described second embodiment, during hammer drill operation, when the compression coil spring 251 is pushed under excessive pressing load in excess of a set value and adjacent coils of the compression coil spring 251 come into close contact with each other, a large impact on the compression coil spring 251 may damage or break the compression coil spring 251. Or the reaction force may be directly transmitted to the body 203 side by contact of the rear ring holder 255 with the ring case 257.

Accordingly, in this modification, in addition to the compression coil spring 251, a cushioning member 261 is provided between the rear ring holder 255 and the ring case 257 in order to absorb the reaction force during hammer drill operation. The cushioning member 261 is a feature that corresponds to the "stopper" according to this invention.

The cushioning member 261 is formed into a ring-like shape by urethane or rubber. The cushioning member 261 is mounted radially outward of the compression coil spring 251 and in an annular mounting groove 257*a* formed in the front surface of the ring case 257 and protrudes a predetermined extent forward from the front surface. The cushioning member 261 may be mounted on the rear ring holder 255 side.

Figure 12:
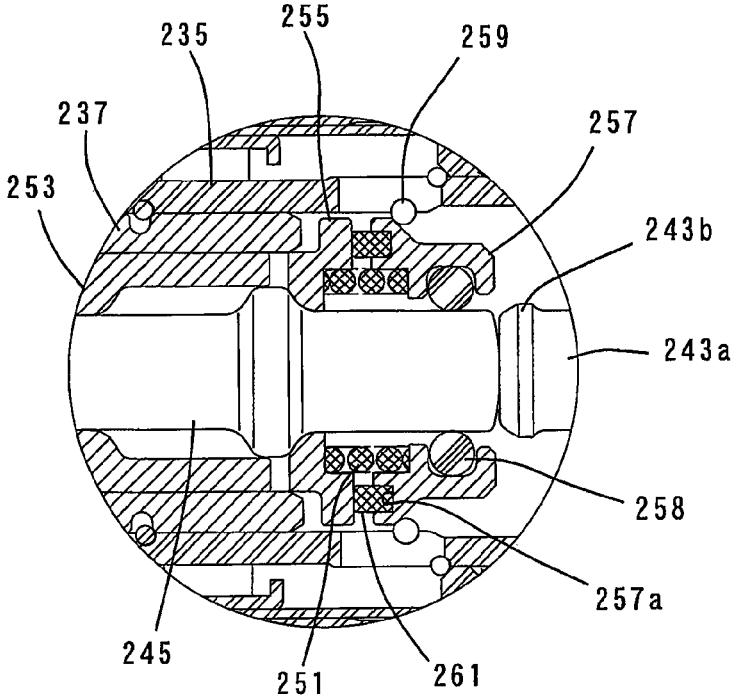
FIG. 12 is also an enlarged view of the essential part of the modification, in the reaction force absorbing state.

According to the modification having the above-described construction, during hammer drill operation, when the compression coil spring 251 is acted upon by large pressing load in excess of a set value, the cushioning member 261 comes into contact with the rear surface of the rear ring holder 255 as shown in FIG. 12. Specifically, the cushioning member 261 contacts the rear surface of the rear ring holder 255 before its coils come into close contact with each other. Therefore, the compression coil spring 251 can be protected against impact which acts upon it by the close contact. Further, the reaction force absorbing effect can be further enhanced by elastic deformation of the cushioning member 261.

Further, in the above-described first embodiment, the idle driving prevention mechanism for preventing the hammer bit 119 from idle driving under unloaded conditions was described as being of the type that controls opening and closing of the air vents 141*b* of the cylinder 141 by means of the striker 143. However, the idle driving prevention mechanism is not limited to this. For example, it may be configured such that a valve member formed by a slide sleeve slidably disposed outside the cylinder 141 is moved by the positioning member 151 and thereby controls opening and closing of the air vents 141*b*. In this case, the slide sleeve is normally spring biased forward and held in an open position for opening the air vents 141*b*. Under loaded conditions in which the hammer bit 119 is pressed against the workpiece, the slide sleeve is moved to a closed position for closing the air vents 141*b* via the positioning member 151 by the impact bolt 145 retracted together with the hammer bit 119. The slide sleeve corresponds to the "movable member" according to this invention.

DESCRIPTION OF NUMERALS

101 electric hammer (impact tool)
103 body (tool body)
105 motor housing
107 gear housing
107*a* spring receiving surface
108 cylindrical member
108*a* engagement surface
109 handgrip
109*a* slide switch
111 driving motor
113 motion converting mechanism
115 striking mechanism
119 hammer bit (hammer actuating member)
121 driving gear
123 driven gear
125 crank plate
126 eccentric shaft
127 crank arm
128 connecting shaft
129 piston (driving element)
137 tool holder
137*a* rear end
141 cylinder
141*a* air chamber
141*b* air vent (communication part)
143 striker (striking element, communication part opening-closing member)
145 impact bolt (hammer actuating member)
145*a* large-diameter portion
145*b* small-diameter portion
145*c* tapered portion
151 positioning member
153 rubber ring
155 front metal washer
157 rear metal washer
158 retaining ring
159 coil spring
161 dynamic vibration reducer
163 weight
165F, 165R biasing spring (elastic element, positioning elastic element)
167 spring receiving member
167*a* flange
171 compression coil spring (elastic element, positioning elastic element)
172 retaining ring
173 spring receiving ring
175 spring receiving member
175*a* flange
201 hammer drill (impact tool)
203 body (tool body)
205 motor housing
207 gear housing
211 driving motor
213 motion converting mechanism
214 power transmitting mechanism
215 striking mechanism
219 hammer bit (hammer actuating member)
221 driving gear
223 driven gear
224 engagement part
225 intermediate shaft
226 bearing
227 rotating element
228 swinging rod
229 swinging ring
231 first transmission gear
233 second transmission gear
235 cylinder guide
237 tool holder
241 cylindrical piston
241*a* air chamber
241*b* air vent (communication part)
243 striker (striking element, communication part opening-closing member)
243*a* striking part
243*b* flange
245 impact bolt (hammer actuating member)
245*a* large-diameter portion
245*b* front small-diameter portion
245*c* rear small-diameter portion
245*d* front tapered portion
245*e* rear tapered portion
251 compression coil spring
253 front ring holder
255 rear ring holder (positioning member)
255*a* inside tapered portion
255*b* large-diameter portion
255*c* small-diameter portion
255*d* engagement surface
257 ring case (facing member)
257*a* mounting groove
258 O-ring
259 retaining ring
261 cushioning member

What we claim is:

1. An impact tool which performs a predetermined hammering operation on a workpiece by a striking movement of a hammer actuating member in its axial direction, including:

a tool body, a cylinder housed within the tool body, a driving element that linearly moves in the axial direction of the hammer actuating member, a striker that linearly moves in the axial direction of the hammer actuating member within the cylinder, and an air chamber defined between the driving element and the striker within the cylinder, wherein the striker is caused to linearly move via pressure fluctuations of the air chamber as a result of the linear movement of the driving element and strikes the hammer actuating member, whereby the predetermined hammering operation is performed on the workpiece, comprising:

a positioning member that is held in contact with the hammer actuating member under loaded conditions in which the hammer actuating member is pressed against the workpiece and pushed towards the driving element, while being separated from the hammer actuating member under unloaded conditions in which the hammer actuating member is not pressed against the workpiece, an elastically deformable positioning elastic element that positions the tool body with respect to the workpiece by contact with the positioning member under loaded conditions, and in this position, absorbs a reaction force that is caused by rebound from the workpiece and inputted from the hammer actuating member via the positioning member, the elastically deformable positioning elastic element being positioned outside the cylinder, a communication part that provides communication between the air chamber and the outside in order to prevent idle driving, and a communication part opening-closing member comprising the striker disposed inside the cylinder, the communication part opening-closing member being movable between a closed position for closing the communication part and an open position for opening the communication part, wherein, under unloaded conditions, the communication part opening-closing member is placed in the open position for opening the communication part and thereby disables the pressure fluctuations of the air chamber, while, under loaded conditions, the communication part opening-closing member is pushed by the hammer actuating member or the positioning member to the closed position for closing the communication part and thereby enables the pressure fluctuations of the air chamber.

2. The impact tool as defined in claim 1, further comprising an elastic member that biases the positioning member forward away from the striker.

3. The impact tool as defined in claim 2, wherein the positioning elastic element and the elastic member are arranged in parallel in the radial direction and in the same position on the axis of the hammer actuating member.

4. The impact tool as defined in claim 1, further comprising a dynamic vibration reducer having a weight that can linearly move under a biasing force of an elastic element and provided to reduce vibration during hammering operation by the movement of the weight in the axial direction of the hammer actuating member.

5. The impact tool as defined in claim 4, wherein the positioning elastic element comprises the elastic element designed as a component part of the dynamic vibration reducer.

6. The impact tool as defined in claim 1, wherein:

the positioning member comprises an annular member that is disposed on the hammer actuating member and can contact an outside portion of the hammer actuating member from the rear, a facing member faces the positioning member with a predetermined clearance therebetween and is disposed rearward of the positioning member in the tool body in such a manner as to be prevented from moving rearward, and the positioning elastic element comprises a coil spring disposed between the positioning member and the facing member.

7. The impact tool as defined in claim 6, wherein an axial front region of the coil spring is placed over an outside portion of the positioning member and wherein a front end of the coil spring is held in contact with the positioning member and located forward of a contact point between the hammer actuating member and the positioning member.

8. The impact tool as defined in claim 6, wherein a stopper is provided on one of the positioning member and the facing member and elastically deforms by contact with the other of the positioning member and the facing member before coils of the coil spring come into close contact when the reaction force is absorbed by compressive deformation of the coil spring.

* * * * *